US011545078B2

(12) United States Patent
Choi

(10) Patent No.: US 11,545,078 B2
(45) Date of Patent: Jan. 3, 2023

(54) DISPLAY DEVICE WITH GATE DRIVER CAPABLE OF PROVIDING HIGH RESOLUTION AND REDUCING DETERIORATION OF IMAGE QUALITY

(71) Applicant: LG Display Co., Ltd., Seoul (KR)

(72) Inventor: Jaeyi Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/525,282

(22) Filed: Nov. 12, 2021

(65) Prior Publication Data

US 2022/0165209 A1 May 26, 2022

(30) Foreign Application Priority Data

Nov. 20, 2020 (KR) ..... 10-2020-0156407

(51) Int. Cl.
*G09G 3/32* (2016.01)

(52) U.S. Cl.
CPC ..... *G09G 3/32* (2013.01); *G09G 2300/0842* (2013.01); *G09G 2310/0291* (2013.01); *G09G 2310/061* (2013.01); *G09G 2310/08* (2013.01)

(58) Field of Classification Search
CPC ..... G09G 3/30; G09G 3/32; G09G 3/3208; G09G 3/3216; G09G 3/3225; G09G 3/3233; G09G 3/3241; G09G 3/3266; G09G 3/3275; G09G 3/36; G09G 3/3611; G09G 3/3614; G09G 3/3622; G09G 3/3625; G09G 3/3674; G09G 3/3677; G09G 3/3681; G09G 3/3685; G09G 3/3688
USPC ..... 345/87–104
See application file for complete search history.

(56) References Cited

U.S. PATENT DOCUMENTS

2011/0157124 A1* 6/2011 Jung ..... G11C 19/28 345/55
2012/0287112 A1* 11/2012 Kim ..... G09G 3/3677 345/212
2013/0100007 A1* 4/2013 Yamamoto ..... G09G 3/36 377/64
2014/0044228 A1* 2/2014 Jang ..... G11C 19/00 377/64
2015/0317954 A1* 11/2015 Jang ..... G09G 3/3677 345/82
2017/0004760 A1* 1/2017 Jang ..... G11C 19/28
2017/0140697 A1* 5/2017 In ..... H01L 27/1255
2017/0169757 A1* 6/2017 Kim ..... G09G 3/20
2019/0103049 A1* 4/2019 Noh ..... G09G 3/3677
2020/0118509 A1* 4/2020 Noh ..... G11C 19/28
2022/0172659 A1* 6/2022 Park ..... G09G 3/20
2022/0208075 A1* 6/2022 Kim ..... G11C 19/28

* cited by examiner

*Primary Examiner* — Alexander Eisen
*Assistant Examiner* — Nelson Lam
(74) *Attorney, Agent, or Firm* — Fenwick & West LLP

(57) ABSTRACT

A gate driver circuit and a display device including the gate driver circuit are disclosed. The gate driver circuit includes a stage for outputting at least two gate signals. The stage comprises, a first output buffer for outputting a first gate signal in response to a voltage of a Q node and the voltage of a Qb node; a second output buffer for outputting a second gate signal in response to the voltage of the Q node and the voltage of the Qb node; and a first diode circuit disposed between the Q node and the second output buffer.

18 Claims, 13 Drawing Sheets

DISPLAY DEVICE WITH GATE DRIVER CAPABLE OF PROVIDING HIGH RESOLUTION AND REDUCING DETERIORATION OF IMAGE QUALITY

CROSS REFERENCE TO RELATED APPLICATION

This application claims priority from Republic of Korea Patent Application No. 10-2020-0156407, filed on Nov. 20, 2020 which is hereby incorporated by reference in its entirety.

BACKGROUND

1. Technical Field

The present disclosure relates to a gate driver circuit and a display device including the same, and more particularly, to a gate driver circuit having improved reliability and a display device including the same.

2. Discussion of the Related Art

As the information society develops, demands for display devices for displaying images are increasing in various forms, and various types of display devices, such as a liquid crystal display device (LCD) and an electroluminescence display device (ELD) are being employed.

The electroluminescence display device (ELD) may include a quantum dot (QD) light emitting display device with a quantum dot (QD), an inorganic light emitting display device, and an organic light emitting display device and so on.

Among the above display devices, the electroluminescence display device (ELD) can be implemented with excellent response speed, viewing angle, color reproducibility, and the like. In addition, there is an advantage that can be implemented with a thin thickness.

Recently, a display device has a large screen, and if the resolution of the display device is low, the size of the pixel increases, which may cause the image quality to be deteriorated. Accordingly, the display device is designed to have high resolution. In addition, in order to increase the aesthetics of the display device and to improve the convenience of operation, a thin bezel is intended to be implemented.

SUMMARY

Accordingly, embodiments of the present disclosure are directed to a gate driver circuit capable of having high resolution and reducing image quality from being deteriorated, and a display device including the same.

The present disclosure provides a gate driver circuit capable of implementing a thin bezel, and a display device including the same.

In one aspect, there may be provided with the gate driver circuit including a stage for outputting at least two gate signals. The stage comprises, a first output buffer for outputting a first gate signal in response to a voltage of a Q node and the voltage of a Qb node; a second output buffer for outputting a second gate signal in response to the voltage of the Q node and the voltage of the Qb node; and a first diode circuit disposed between the Q node and the second output buffer.

In another aspect, there may be provided with a display device comprising: a display panel comprising a plurality of pixels receiving data signals and gate signals respectively from a plurality of data lines and a plurality of gate lines; a data driver circuit for supplying the data signals to the plurality of data lines; a gate driver circuit for sequentially supplying the gate signals to the plurality of gate lines and comprising a stage for outputting at least two gate signals; and a timing controller for controlling the data driver circuit and the gate driver circuit. The stage may comprise, a first output buffer for outputting a first gate signal in response to a voltage of a Q node and the voltage of a Qb node, a second output buffer for outputting a second gate signal in response to the voltage of the Q node and the voltage of the Qb node, and a first diode circuit disposed between the Q node and the second output buffer.

According to the gate driver circuit and a display device including the same, there may have high resolution and prevent image quality from being deteriorated.

According to the gate driver circuit and a display device including the same, there may implement a thin bezel.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
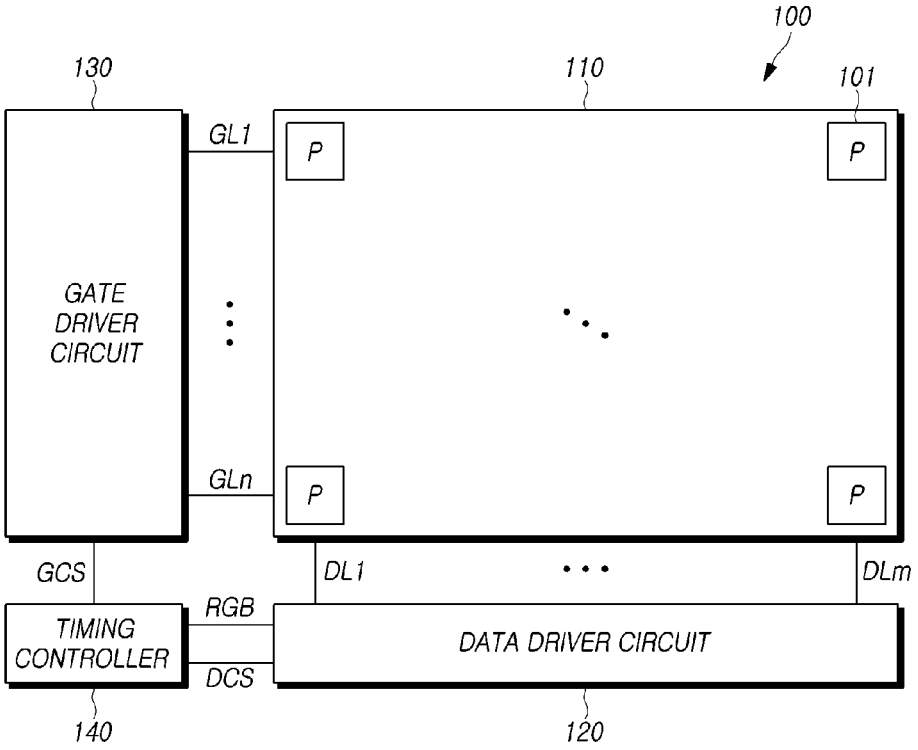
FIG. 1 is a structural diagram of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including", "having", "containing", and "constituting" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 is a structural diagram illustrating a structure of a display device according to embodiments of the present disclosure.

Referring to FIG. 1, the display device 100 may include a display panel 110, a data driver circuit (or data driver) 120, a gate driver circuit (or gate driver) 130, and a timing controller 140.

The display panel 110 may include a plurality of pixels (P) 101 disposed with a form of matrix.

The display panel 110 may include a plurality of data lines DL1 to DLm extending in the first direction and a plurality of gate lines GL1 to GLn extending in the second direction. The plurality of pixels 101 are connected to the plurality of data lines DL1 to DLm and the plurality of gate lines GL1 to GLn. One pixel 101 may operate by receiving a data signal transmitted through a connected data line in response to a gate signal transmitted through a connected gate line.

The data driver circuit 120 may be connected to the plurality of data lines DL1 to DLm and may supply the data signal to the plurality of pixels through the plurality of data lines DL1 to DLm.

The gate driver circuit 130 is connected to the plurality of gate lines GL1 to GLn and can supply the gate signal to the plurality of gate lines GL1 to GLn. Although the gate driver circuit 130 is disposed on one side of the display panel 110, the gate driver circuit 130 is not limited thereto, and the gate driver circuit 130 may be disposed on both sides of the display panel 110. The gate driver disposed on the left side may be connected to the odd-numbered gate line, and the gate driver disposed on the right side of the display panel 110 may be connected to the even-numbered gate line.

The timing controller 140 may control the data driver circuit 120 and the gate driver circuit 130. The timing controller 140 may supply video signals RGB and data control signals DCS to the data driver circuit 120, and gate control signals GCS to the gate driver circuit 130.

Figure 2:
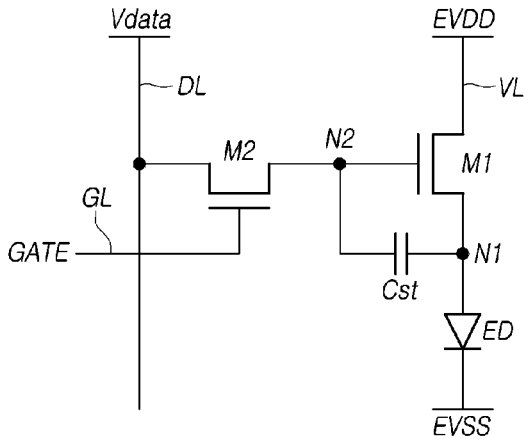
FIG. 2 is a circuit diagram of a pixel according to embodiments of the present disclosure.

FIG. 2 is a circuit diagram of a pixel according to embodiments of the present disclosure.

Referring to FIG. 2, the pixel 101 may include a first transistor M1, a second transistor M2, a storage capacitor Cst, and a light emitting element ED receiving the driving current and emitting light.

The first electrode of the first transistor M1 may be connected to the first power line VL1 through which the first power EVDD is transmitted, and the second electrode may be connected to connected to the first node N1. The first transistor M1 may cause the driving current to flow to the first node N1 in response to the data voltage Vdata applied to the second node N2.

The first electrode of the second transistor M2 may be connected to the data line DL transferring the data voltage Vdata, and the second electrode may be connected to the second node N2. In addition, the gate electrode of the second transistor M2 may be connected to the gate line GL supplying the gate signal GATE. The second transistor M2 may receive the gate signal GATE and supply the data voltage Vdata transferred to the data line DL to the gate electrode of the first transistor M1. The gate signal may be supplied from the gate driver 130 shown in FIG. 1.

The first electrode of the storage capacitor Cst may be connected to the first node N1, and the second electrode may be connected to the second node N2. The storage capacitor Cst may be disposed between the first node N1 and the second node N2, so that the voltage difference between the first node N1 and the second node N2 can be maintained.

The first electrode of the light emitting element ED may be connected to the first node N1, and the second electrode may be connected to the second power EVSS. The light emitting element ED may include a light emitting layer that emits light by a current flowing between the first and the second electrodes. The light emitting layer may be at least one of an organic material, an inorganic material, and a quantum-dot material. The light emitting element ED may emit light in response to the current flowing from the first electrode to the second electrode.

In the pixel 101 configured as described above, the first transistor M1 and the second transistor M2 may be N-MOS type transistors. However, the present disclosure is not limited thereto. In addition, the first electrode and the second electrode of the first to second transistors M1 to M2 may be a drain electrode and a source electrode, respectively. However, the present disclosure is not limited thereto.

Figure 3:
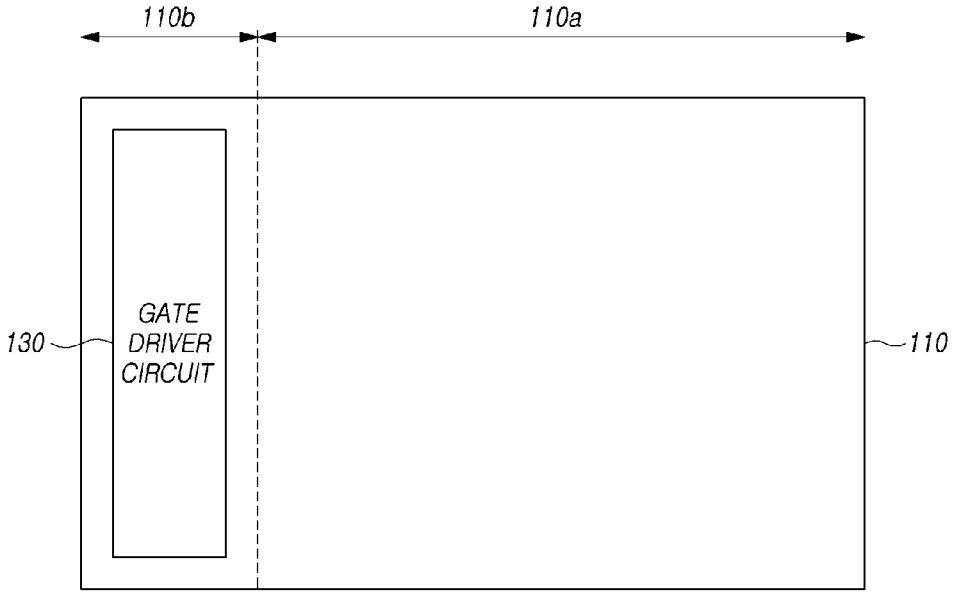
FIG. 3 conceptually illustrates a gate driver disposed on a display panel in a display device according to embodiments of the present disclosure.

FIG. 3 conceptually illustrate a gate driver disposed on a display panel in a display device according to embodiments of the present disclosure.

Referring to FIG. 3, the display device 100 may include a display panel 110 and a gate driver circuit 130 disposed on the display panel 110.

The display panel 110 includes a display area 110*a* in which a pixel 101 is disposed, and a non-display area 110*b* in which a signal line for supplying a signal and/or a voltage to the pixel 101 is disposed. The gate driver circuit 130 may be disposed in the non-display area 110*b*. The gate driver circuit 130 may be formed simultaneously in the non-display area 110*b* with the process of forming the pixel 101 in the display area 110*a*.

Figure 4:
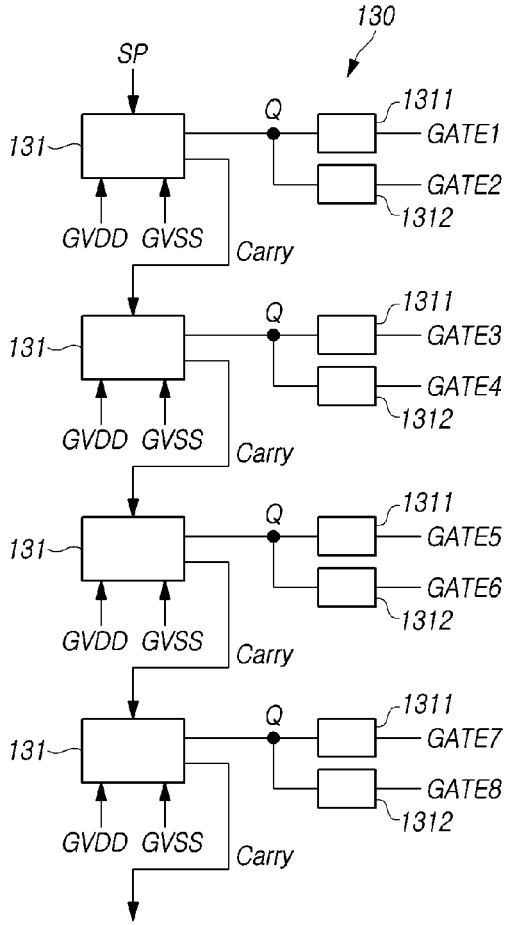
FIG. 4 is a structural diagram illustrating a gate driver circuit according to embodiments of the present disclosure.
Figure 5:
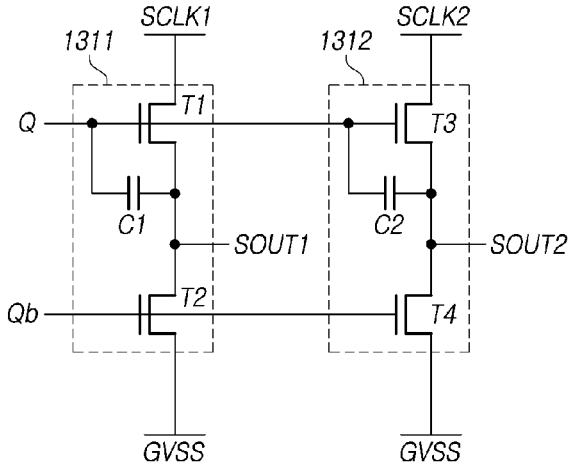
FIG. 5 is a circuit diagram of a first output buffer and a second output buffer employed in the gate driver circuit shown in FIG. 4 according to embodiments of the present disclosure.

FIG. 4 is a structural diagram illustrating a gate driver circuit 130 according to embodiments of the present disclosure. FIG. 5 is a circuit diagram of a first output buffer and a second output buffer employed in the gate driver circuit shown in FIG. 4 according to embodiments of the present disclosure.

Referring to FIGS. 4 and 5, the gate driver circuit 130 may include a plurality of stages 131, and a first output buffer 1311 and a second output buffer 1312 connected to each stage 131.

Each stage 131 may receive a high voltage GVDD and a low voltage GVSS, and may transmit a predetermined voltage to the Q node and the Qb node, respectively.

The first stage 131 may start operation by receiving the start pulse SP, and the remaining stages 131 may sequentially receive the carry signal Carry from the upper stage to operate. Each stage generates the carry signal Carry and transfers the carry signal Carry to the next stage, but is not limited thereto. For example, each stage 131 may generate a carry signal Carry in response to a clock signal and the voltage of a Q node and transmit the generated carry signal Carry to the next stage.

The voltages transferred to the Q node and the Qb node may have opposite polarities from each other. When the voltage level of the Q node is in a high state, the voltage of the Qb node may be in a low state. Conversely, when the voltage level of the Q node is in a low state, the voltage of the Qb node may be in a high state.

The first output buffer 1311 and the second output buffer 1312 may output two different gate signals in response to the voltages of the Q node and the Qb node. For example, the first output buffer 1311 may output the first gate signal GATE1 (or GATE5, GATE5, GATE7) in response to the voltage of the Q node and the voltage of the Qb node, and the second output buffer 1312 may output the second gate signal GATE2 (or GATE4, GATE6, GATE5) in response to the voltage of the Q node and the voltage of the Qb node.

The first output buffer 1311 includes a first transistor T1 including a first electrode to which a first clock signal SCLK1 is transmitted, a second electrode connected to a first output terminal SOUT1, and a gate electrode to which the voltage of the Q node is transmitted, a second transistor T2 including a first electrode connected to the first output terminal SOUT1, a second electrode to which a low voltage GVSS is transmitted and a gate electrode to which the voltage of the Qb node is transmitted, and a first capacitor C1 disposed between the gate electrode of the first transistor and the first output terminal.

When the first transistor T1 is turned on by the voltage of the Q node, it may transmit the first clock signal SCLK1 to the first output terminal SOUT1. In this case, the second transistor T2 may be turned off by the voltage of the Qb node. Also, the first transistor T1 may be turned off by the voltage of the Q node. When the first transistor T1 is turned off, the second transistor T2 may be turned on by the voltage of the Qb node. When the second transistor T2 is turned on, the low voltage GVSS may be transmitted to the first output terminal SOUT1.

The second output buffer 1312 includes a third transistor T3 including a first electrode to which a second clock signal SCLK2 is transmitted, a second electrode connected to a second output terminal SOUT2, and a gate electrode to which the voltage of the Q node is transmitted, a fourth transistor T4 including a first electrode connected to the second output terminal SOUT2, a second electrode to which a low voltage GVSS is transmitted and a gate electrode to which the voltage of the Qb node is transmitted, and a second capacitor C2 disposed between the gate electrode of the third transistor T3 and the second output terminal SOUT2.

When the third transistor T3 is turned on by the voltage of the Q node, it may transmit the second clock signal SCLK2 to the second output terminal SOUT2. In this case, the fourth transistor T4 may be turned off by the voltage of the Qb node. The third transistor T3 may be turned off by the voltage of the Q node. When the third transistor T3 is turned off, the fourth transistor T4 may be turned on by the voltage of the Qb node. When the fourth transistor T4 is turned on, the low voltage GVSS may be transferred to the second output terminal SOUT2.

Each stage 131 of the gate driver circuit 130 may output the first gate signal and the second gate signal through two output buffers 1311 and 1312. Accordingly, the number of stages included in the gate driver circuit 130 may be decreased, thereby reducing the size of the gate driver circuit 130. As the size of the gate driver circuit 130 is reduced, the area of the non-display area 110*b* of the display panel 110 may be reduced, and thus the bezel of the display device 100 may be implemented to be thin.

Figure 6:
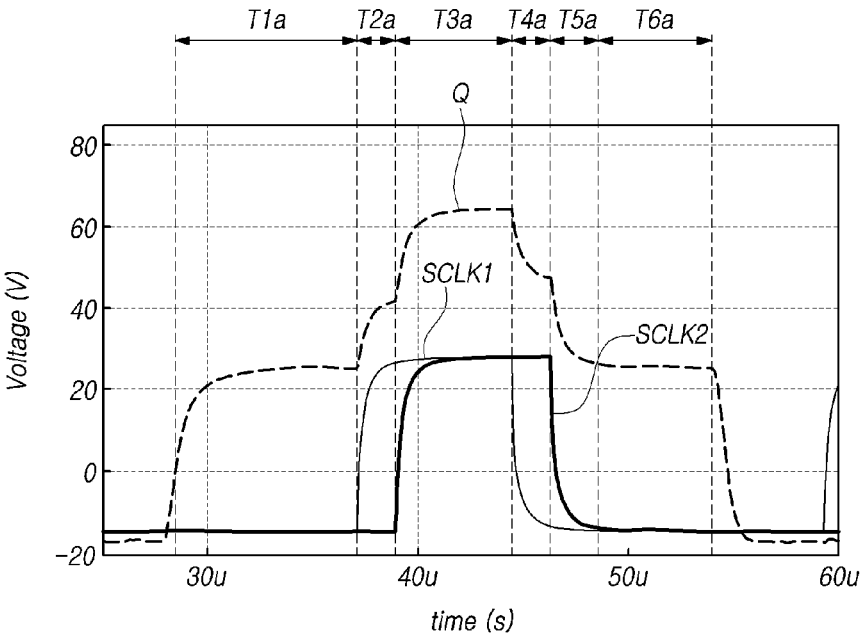
FIG. 6 is a timing diagram illustrating a voltage change of the first node in the gate driver circuit shown in FIG. 4 according to embodiments of the present disclosure.

FIG. 6 is a timing diagram illustrating a voltage change of the first node in the gate driver circuit shown in FIG. 4 according to one embodiment.

Referring to FIG. 6, the voltage of the Q node is in a high state in the first period T1*a* to the sixth period T6*a*, and the first clock signal SCLK1 rises in the second period T2*a*, maintains a high state in the third period T3*a*, and falls in the fourth period T4*a*. Then, the second clock signal SCLK2 rises in the third period T3*a*, maintains a high state until the fourth period T4*a*, and falls in the fifth period T5*a*.

In the first period T1*a* to the sixth period T6*a*, the first transistor T1 and the third transistor T3 maintain the turn-on state, and the first clock signal SCLK1 rising in the second period T2*a* may be transmitted to the first output terminal SOUT1 through the first transistor T1. In addition, the second clock signal SCLK2 rising in the third period T3*a* may be transmitted to the second output terminal SOUT2 through the third transistor T3.

The first capacitor C1 is disposed between the Q node and the first output terminal SOUT1, the second capacitor C2 is connected to the Q node and the second output terminal SOUT2 so that, when the voltage of the first output terminal SOUT1 or the second output terminal SOUT2 increases, the voltage of the Q node may increase.

Accordingly, since the first clock signal SCLK1 is rising during the second period T2*a* in which the first clock signal SCLK1 is transmitted to the first output terminal SOUT1, the voltage level of the Q node may be increased. Also, since the second clock signal SCLK2 is rising during the third period T3*a* in which the second clock signal SCLK2 is transmitted to the second output terminal SOUT2, the voltage level of the Q node may be increased.

Accordingly, the voltage level of the Q node may rise further in the third period T3*a* after rising in the second period T2*a*.

Since the first clock signal SCLK1 transmitted to the first output terminal SOUT1 through the first transistor T1 in the fourth period T4*a* starts to fall, the voltage level of the Q node may be decreased. Since the second clock signal SCLK2 transmitted to the second output terminal SOUT2 through the third transistor T3 in the fifth period T5*a* starts to fall, the voltage level of the Q node further may be decreased.

As an example, the first gate signal GATE1 and the second gate signal GATE2 output from one stage 131 of the gate driver circuit 130 may be output from the first output buffer 1311 and the second output buffer 1312, respectively. In addition, the first gate signal GATE1 and the second gate signal GATE2 may be a turn-on signal or a turn-off signal in response to the voltage of the Q node.

As another example, the first gate signal GATE 1 may be a gate signal transmitted to one of a plurality of odd-numbered gate lines disposed on the display panel 110, and the second gate signal GATE2 may be a gate signal transferred to one of the plurality of even-numbered gate lines, but are not limited thereto.

Figure 7:
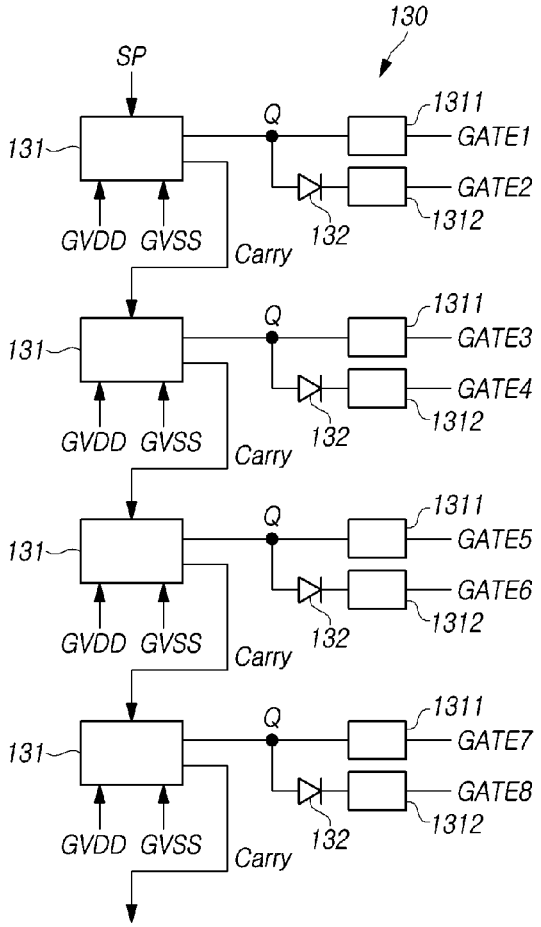
FIG. 7 is a structural diagram illustrating a gate driver circuit according to another embodiment of the present disclosure.
Figure 8:
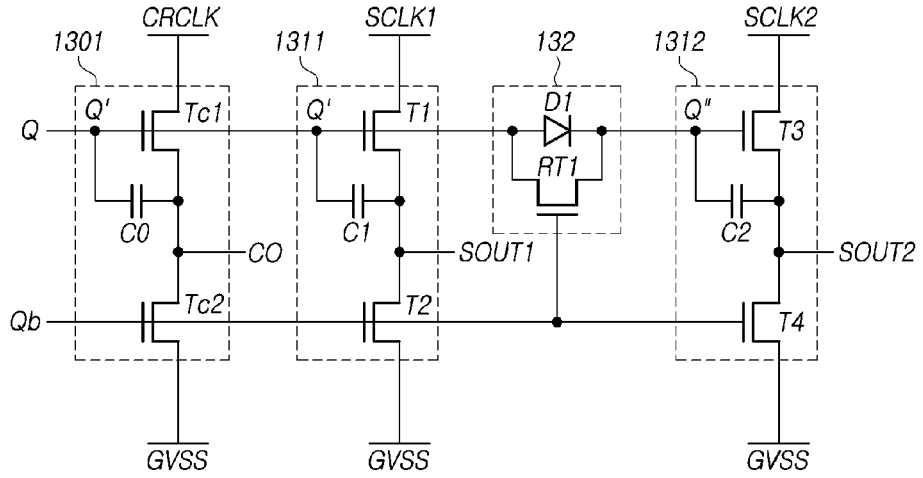
FIGS. 8 and 9 are circuit diagrams of a first output buffer, a second output buffer, and a carry buffer in the gate driver circuit in FIG. 7 according to the other embodiment of the present disclosure.
Figure 9:
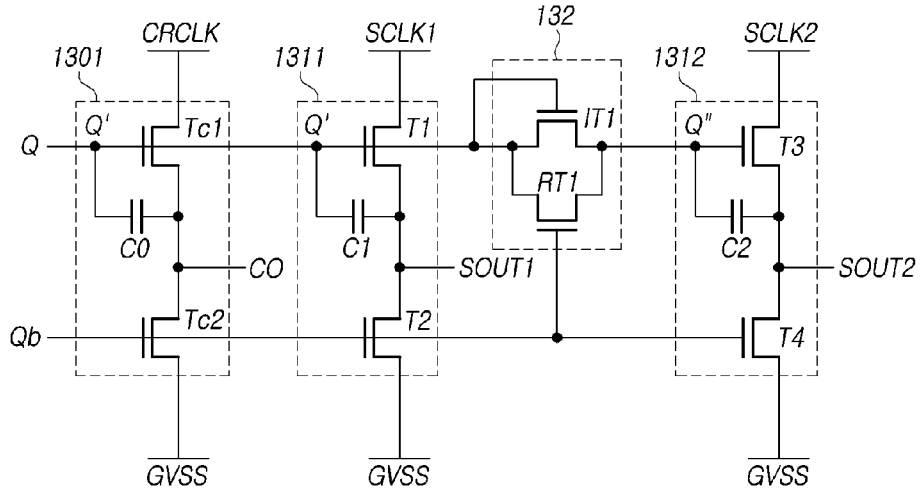

FIG. 7 is a structural diagram illustrating a gate driver circuit according to another embodiment. FIGS. 8 and 9 are circuit diagrams of a first output buffer, a second output buffer, and a carry buffer in the gate driver circuit in FIG. 7 according to another embodiment.

Referring to FIGS. 7 to 9, the gate driver circuit 130 may include a plurality of stages 131, a first output buffer 1311 and a second output buffer 1312 connected to each stage 131.

Each stage 131 may receive a high voltage GVDD and a low voltage GVSS, and may transmit a predetermined voltage to the Q node and the Qb node, respectively.

The first stage 131 may start operation by receiving the start pulse SP, and the remaining stages 131 may sequentially receive the carry signal Carry from the upper stage to operate. Each stage generates a carry signal Carry and transfers the carry signal Carry to the next stage, but is not limited thereto. For example, each stage 131 may generate a carry signal Carry in response to a clock signal and the voltage of a Q node and transmit the generated carry signal Carry to the next stage.

The voltages transferred to the Q node and the Qb node may have opposite polarities from each other. When the voltage level of the Q node is in a high state, the voltage of the Qb node may be in a low state. Conversely, when the voltage level of the Q node is in a low state, the voltage of the Qb node may be in a high state.

The first output buffer 1311 and the second output buffer 1312 may output two different gate signals in response to the voltages of the Q node and the Qb node. For example, the first output buffer 1311 may output the first gate signal GATE1 (or GATE5, GATE5, GATE7) in response to the voltage of the Q node and the voltage of the Qb node, and the second output buffer 1312 may output the second gate signal GATE2 (or GATE4, GATE6, GATE8) in response to the voltage of the Q node and the voltage of the Qb node.

The first output buffer 1311 includes a first transistor T1 including a first electrode to which a first clock signal SCLK1 is transmitted, a second electrode connected to a first output terminal SOUT1, and a gate electrode to which the voltage of the Q node is transmitted, and, a second transistor T2 including a first electrode connected to the first output terminal SOUT1, a second electrode to which a low voltage GVSS is transmitted and a gate electrode to which the voltage of the Qb node is transmitted, and a first capacitor C1 disposed between the gate electrode of the first transistor and the first output terminal.

When the first transistor T1 is turned on by the voltage of the Q node, it may transmit the first clock signal SCLK1 to the first output terminal SOUT1. In this case, the second transistor T2 may be turned off by the voltage of the Qb node. Also, the first transistor T1 may be turned off by the voltage of the Q node. When the first transistor T1 is turned off, the second transistor T2 may be turned on by the voltage of the Qb node. When the second transistor T2 is turned on, the low voltage GVSS may be transmitted to the first output terminal SOUT1.

The second output buffer 1312 includes a third transistor T3 including a first electrode to which a second clock signal SCLK2 is transmitted, a second electrode connected to a second output terminal SOUT2, and a gate electrode to which the voltage of the Q node is transmitted, a fourth transistor T4 including a first electrode connected to the second output terminal SOUT2, a second electrode to which a low voltage GVSS is transmitted and a gate electrode to which the voltage of the Qb node is transmitted, and a second capacitor C2 disposed between the gate electrode of the third transistor T3 and the second output terminal SOUT2.

When the third transistor T3 is turned on by the voltage of the Q node, it may transmit the second clock signal SCLK2 to the second output terminal SOUT2. In this case, the fourth transistor T4 may be turned off by the voltage of the Qb node. The third transistor T3 may be turned off by the voltage of the Q node. When the third transistor T3 is turned off, the fourth transistor T4 may be turned on by the voltage of the Qb node. When the fourth transistor T4 is turned on, the low voltage GVSS may be transferred to the second output terminal SOUT2.

A first diode circuit 132 may be connected between the Q node and the second output buffer 1312. The first diode circuit 132 may be disposed between the Q node and the gate electrode of the third transistor T3. When the voltage level of the Q node is greater than the voltage level of the gate electrode of the third transistor T3, a current flows from the Q node to the gate electrode of the third transistor T3 by the first diode circuit 132. However, when the voltage level of the Q node is less than the voltage level of the gate electrode of the third transistor T3, the current may not flow from the gate electrode of the third transistor T3 to the Q node due to the first diode circuit 132.

The Q node may be divided into a Q node and a Q" node by the first diode circuit 132. The Q' node may be connected to the gate electrode of the first transistor T1, and the Q" node may be connected to the gate electrode of the third transistor T3.

As shown in FIG. 8, the first diode circuit 132 comprises a first diode D1 in which an anode electrode is connected to the Q' node and a cathode electrode is connected to the Q" node, and a first reset transistor RT1 in which a first electrode is connected to the Q' node, a second electrode is connected to the Q" node and a gate electrode is connected to the Qb node. As a result, a cathode electrode of the first diode D1 is connected to the gate node of the third transistor T3. The first electrode is connected to the gate node of the first transistor T1.

The first diode D1 may prevent a current from flowing from the Q" node to the Q' node. Since the first reset transistor RT1 is connected to the Qb node, when the Q node is in a high state, the first reset transistor RT1 may be in an off state.

When the Q node is in a high state, the Qb node is in a low state and the first reset transistor RT1 is in an off state. Therefore, even if the voltage applied to the Q node is less than the voltage level applied to the gate electrode of the third transistor T3, the first diode circuit 132 allows a current not to flow from the Q" node to the Q node by the first reset transistor RT1.

On the other hand, when the Q node is in a low state, the Qb node is in a high state and the first reset transistor RT1 may be in an on state. When the first reset transistor RT1 is turned on, the Q' node and the Q" node may be connected to each other. Since the Q node is in the low state, the Q' node and the Q" node may be in the low state.

As shown in FIG. 9, the first diode circuit 132 includes a first isolation transistor IT1 in which a first electrode is connected to the Q node, a second electrode is connected to a gate electrode of the third transistor T3, and a gate electrode is connected to the Q node, and a first reset transistor RT1 in which a first electrode is connected to the Q node, a second electrode is connected to a gate electrode of the third transistor, and a gate electrode is connected to the Qb node.

The first isolation transistor IT1 is connected as a diode because the first electrode and the gate electrode are connected to the Q node at the same time, so that the first isolation transistor IT1 allows a current to flow from the Q node to the gate electrode of the third transistor T3, but prevents a current from flowing from the gate electrode of the third transistor T3 to the Q node.

Since the first reset transistor RT1 is connected to the Qb node, when the Q node is in a high state, the first reset transistor RT1 may be in an off state. Since the first reset transistor RT1 is in the off state, even if the voltage applied to the Q node is less than the voltage level applied to the gate electrode of the third transistor T3, it is possible to prevent a current from flowing from the gate electrode of the third transistor T3 to the direction of the Q node.

On the other hand, when the Q node is in a low state, the Qb node may be in a high state and the first reset transistor RT1 may be in an on state. When the first reset transistor RT1 is turned on, the voltage applied to the Q node may be reset.

In addition, although it is illustrated that the carry signal Carry is transferred from one stage to another in FIG. 7, the embodiment is not limited thereto, and the carry signal Carry may be output through a separate buffer and be delivered to the next stage. To this end, the gate driver circuit 130 may further include a carry buffer 1301 that outputs a carry signal Carry in response to the voltages of the Q node and the Qb node. The carry buffer 1301 may receive the carry clock signal CRCLK and output the carry signal Carry in response to the voltages of the Q node and the Qb node.

The carry buffer 1301 may include a first carry transistor Tc1, a second carry transistor Tc2 and a carry capacitor C0. The first carry transistor Tc1 may include a first electrode to which the carry clock signal CRCLK is transmitted, a second electrode connected to the carry signal output terminal CO, and a gate electrode to which the voltage of the Q node is transmitted. The second carry transistor Tc2 may include a first electrode which is connected to the carry signal output terminal CO, a second electrode through which the low voltage GVSS is transmitted, and a gate electrode through which the voltage of the Qb node is transmitted. The carry capacitor C0 may be disposed between the gate electrode of the first carry transistor Tc1 and the carry signal output terminal CO.

When the first carry transistor Tc1 is turned on by the voltage of the first node Q, it may transmit the carry clock signal CRCLK to the carry signal output terminal CO. In this case, the second carry transistor Tc2 may be turned off by the voltage of the Qb node. When the first carry transistor Tc1 is turned off by the voltage of the Q node, the second carry transistor Tc2 may be turned on by the voltage of the Qb node. When the second carry transistor Tc2 is turned on, the low voltage GVSS may be transmitted to the carry signal output terminal CO. The first diode circuit 132 as shown in FIG. 9 may be also disposed between the Q node and the first output buffer 1311.

Figure 10:
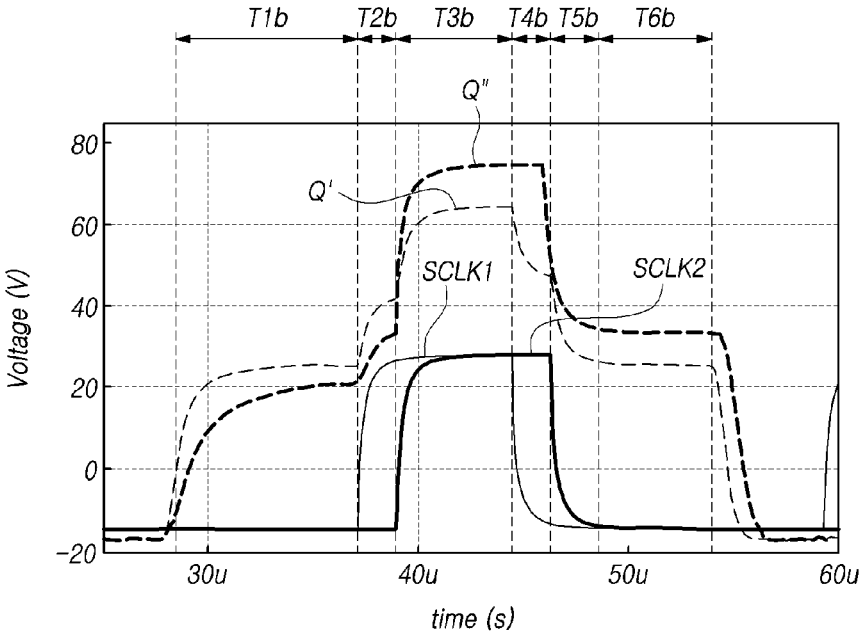
FIG. 10 is a timing diagram illustrating a voltage change of the first node in the gate driver circuit shown in FIG. 7 according to the other embodiment of the present disclosure.

FIG. 10 is a timing diagram illustrating a voltage change of the first node in the gate driver circuit shown in FIG. 7 according to the other embodiment.

Referring to FIG. 10, the Q node may be divided into the Q node connected to the gate electrode of the first transistor T1 and the Q" node connected to the gate electrode of the third transistor T3. In addition, the first capacitor C1 is disposed between the gate electrode of the first transistor T1 and the first output terminal SOUT1, and the second capacitor C2 is disposed between the gate electrode of the third transistor T3 and the second output terminal SOUT2, so that when the voltage of the first output terminal SOUT1 rises, the voltage of the Q node connected to the gate electrode of the first transistor T1 rises and the voltage of the second output terminal SOUT2 rises, the voltage of the Q" node connected to the gate electrode of the third transistor T3 may rise.

In addition, when the voltage applied to the Q' node connected to the gate electrode of the first transistor T1 rises in response to the operation of the first transistor T1, the voltage level of the Q" node connected to the gate electrode of the third transistor T3 of the second output buffer 1312 may be increased. Also, the voltages of the Q node and the Q" node may further rise by the carry clock signal CRCLK.

However, since the first diode circuit 132 is disposed between the Q node and the gate electrode of the third transistor T3 of the second output buffer 1312, even if the voltage applied to the Q' node connected to the gate electrode of the first transistor T1 in response to the operation of the first transistor T1 falls, the voltage level of the Q" node connected to the gate electrode of the third transistor T3 of the second output buffer 1312 may not be decrease. On the other hand, when the voltage level applied to the Q" node connected to the gate electrode of the third transistor T3 decreases in response to the operation of the third transistor T3, the voltage of the Q' node connected to the gate electrode of the first transistor T1 may fall.

The voltage of the Q node is in a high state in the first period T1*b* to the sixth period T6*b*, and the first clock signal SCLK1 rises in the second period T2*b*, maintains a high state in the third period T3*b* and falls in the fourth period T4*b*. Then, the second clock signal SCLK2 rises in the third period T3*b*, maintains a high state in the fourth period T4*b*, and falls in the fifth period T5*b*.

The first transistor T1 and the third transistor T3 maintain the turn-on state in the first period T1*b* to the sixth period T6*b*, and the first clock signal SCLK1 rising in the second period T2*b* may be transmitted to the first output terminal SOUT1 through the first transistor T1. In addition, the second clock signal SCLK2 rising in the third period T3*b* may be transmitted to the second output terminal SOUT2 through the third transistor T3.

Accordingly, when the first clock signal SCLK1 is transmitted to the first output terminal SOUT1 in the second period T2*b*, the first clock signal SCLK1 rises. Therefore, the voltage level of the Q node and the voltage level of the Q" node may increase. Also, when the second clock signal SCLK2 is transmitted to the second output terminal SOUT2 in the third period T3*b*, the second clock signal SCLK2 rises, the voltage level of the Q node and the voltage level of the Q" node may increase. Also, in the third period T3*b*, the voltage levels of the Q' node and the Q" node may be further increased by the carry clock signal CRCLK. Here, the carry clock signal CRCLK is illustrated as being synchronized with the second clock signal SCLK2, but is not limited thereto. Also, the carry clock signal CRCLK may be disposed between the first clock signal SCLK1 and the second clock signal SCLK2.

Accordingly, the voltage levels of the Q node and the Q" node may rise further in the third period T3*b* after rising in the second period T2*b*.

Then, in the fourth period T4*b*, the first clock signal SCLK1 transmitted to the first output terminal SOUT1 through the first transistor T1 starts to fall. When the first clock signal SCLK1 starts to fall, the voltage level of the Q node is decreased. However, since the first diode circuit 132 is connected between the Q node and the gate electrode of the third transistor T3, the voltage level of the gate electrode of the third transistor T3 in the fourth period T4*b* is not decreased. In the fourth period T4*b*, the voltage level of the gate electrode of the first transistor T1 is decreased and the voltage level of the first gate signal GATE1 output from the first output terminal SOUT1 starts to decrease. Since the voltage level of the gate electrode of the third transistor T3 is not decreased, the second gate signal GATE2 output from the second output terminal SOUT2 maintains the high state.

Then, in the fifth period T5*b*, the second clock signal SCLK2 transmitted to the second output terminal SOUT2 through the third transistor T3 starts to fall. When the second clock signal SCLK2 starts to fall, the voltage level of the gate electrode of the third transistor T3 is decreased. Accordingly, the voltage level of the second gate signal GATE2 output from the second output terminal SOUT2 starts to be decreased. Also, the voltage level of the first gate signal GATE1 output from the first output terminal SOUT1 continues to be decreased.

After the voltage levels of the Q node and the Q" node maintain a high state in the sixth period T6*b*, when the second transistor T2 and the fourth transistor T4 is turned on, the voltage levels of the Q' node and the Q" node may become a low state.

When the voltage applied to the Q' node is lowered, the gate electrode of the third transistor T3 is not connected and isolated to the Q' node by the first diode circuit 132 so that even if the voltage level of the Q' node is lowered, the voltage level of the Q" node may not be lowered. Since a signal with a high voltage level has a shorter falling time than a signal with a low voltage level or has a steeper falling slope at the falling time, the falling time of the Q" node voltage when the voltage level of the voltage is high may be shorter or the falling slope may become steeper than that when the voltage level is low. However, the embodiment is not limited thereto, and a signal with a high voltage level may have the same falling time as a signal with a low voltage level, or may have the same falling slope at a falling time.

If the falling time of the Q" node voltage is short or the falling slope is steep, the third transistor T3 quickly reaches the off state, and the second gate signal GATE2 output from the second output terminal SOUT2 may quickly reach a low state. That is, when the voltage level of the Q" node is high, the falling time of the second gate signal GATE2 may be shortened.

Therefore, if the voltage level of the Q" node is prevented from being lowered before the voltage level of the second clock signal SCLK2 is lowered, the falling time of the second gate signal GATE2 may be shorter than the falling time of the first gate signal GATE1. In addition, the slope of the second gate signal GATE2 at the falling time of the second gate signal GATE2 may be steeper than the slope of the first gate signal GATE1 at the falling time of the first gate signal GATE1. However, the embodiment is not limited thereto, and the falling time of the second gate signal GATE2 may be the same as the falling time of the first gate signal GATE1, and the slope of the second gate signal GATE2 at the falling time of the second gate signal GATE2 may be equal to the slope of the first gate signal GATE1 at the falling time of the first gate signal GATE1.

Figure 11:
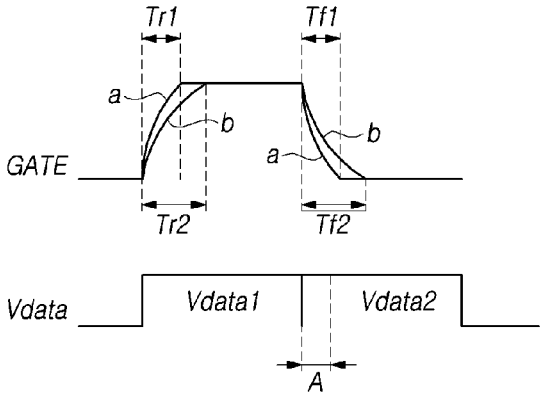
FIG. 11 is a timing diagram for explaining a problem in which data signals are mixed in a pixel corresponding to a length of a falling time of a gate signal.

FIG. 11 is a timing diagram for explaining a problem in which data signals are mixed in a pixel corresponding to a length of a falling time of a gate signal.

Referring to FIG. 11, "a" indicates that the gate signal GATE has a first rising time Tr1 and a first falling time Tf1, and "b" indicates that the gate signal GATE, has a second rising time Tr2 and a second falling time Tf2. The first rising time Tr1 and the first falling time Tf1 may be shorter than the second rising time Tr2 and the second falling time Tf2, respectively.

The first data signal Vdata1 and the second data signal Vdata7 may sequentially flow through the data line DL shown in FIG. 2. The first data signal Vdata1 and the second data signal Vdata7 may be maintained on the data line DL for one horizontal time period 1H, respectively.

The first data signal Vdata1 may be supplied and then the second data signal Vdata7 may be supplied to the data line DL. The second transistor T2 is turned on by the gate signal GATE, so that the first data signal Vdata1 supplied to the data line DL may be stored in the capacitor Cst.

When the second data signal Vdata7 is applied to the data line DL, as shown in a of FIG. 11, if the falling time Tf1 of the gate signal GATE is short, the gate signal GATE may be turned off and the pixel 101 may not receive the second data signal Vdata2. However, as shown in "b" of FIG. 11, if the falling time Tf2 of the gate signal GATE is long, the gate signal GATE does not turn off. Therefore, since the pixel 101 receives the second data signal Vdata7 for the period A, a problem of mixing data signals Vdata may occur.

When the falling time Tf2 of the gate signal GATE is long, the first data signal Vdata1 and the second data signal Vdata7 are sequentially transmitted to the capacitor Cst while the gate signal GATE is maintained. Therefore, a problem occurs that the driving current flowing through the pixel 101 does not correspond to the first data signal Vdata1.

As described above, when the falling time of the gate signal GATE is short, the supply of the first data signal Vdata1 and the second data signal Vdata7 to one pixel can be prevented or at least reduced. In particular, when the display device 100 is implemented with a high resolution, the falling time of the gate signal GATE, needs to be shortened because the time during which the data signal is written should be short.

For the same reason as above, when the two gate signals GATE1 and GATE2 are output from one Q node, the falling time of the second gate signal GATE2 is longer than that of the first gate signal GATE1. In this case, when the second gate signal GATE2 is supplied by the falling time of the second gate signal GATE2, a problem in which data signals are mixed may occur. However, when two gate signals are output from one Q node, the falling time of the second gate signal GATE2 may be shorter than or equal to that of the first gate signal GATE1. In that case, the problem of mixing data signals by the second gate signal GATE2 may not occur.

Figure 12:
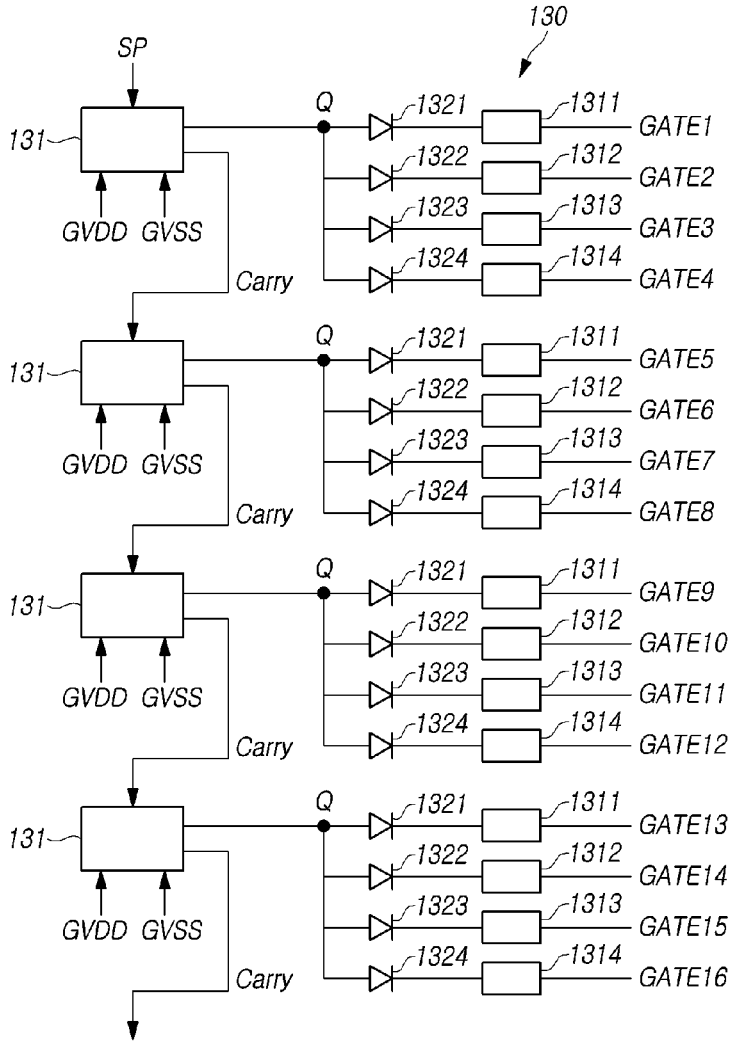
FIG. 12 is a structural diagram illustrating a gate driver circuit according to another embodiment.
Figure 13:
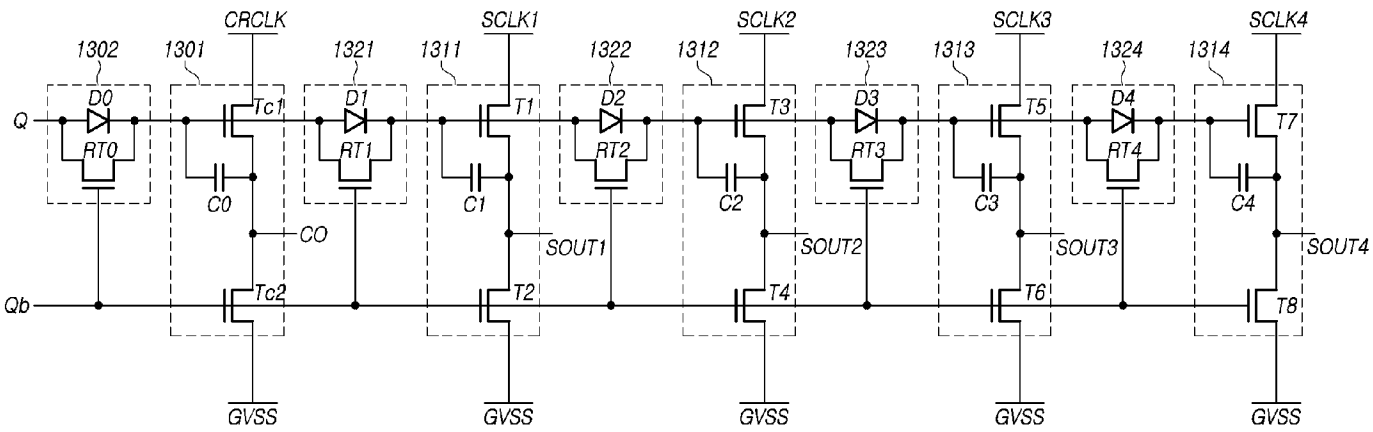
FIG. 13 is a circuit diagram of the first to fourth output buffers and the carry buffer in the gate driver circuit shown in FIG. 12 according to the other embodiment.

FIG. 12 is a structural diagram illustrating a gate driver circuit according to another embodiment. FIG. 13 is a circuit diagram of the first to fourth output buffers and the carry buffer in the gate driver circuit shown in FIG. 12 according to the other embodiment.

Referring to FIGS. 12 and 13, the gate driver circuit 130 may include a plurality of stages 131 and a first output buffer 1311, a second output buffer 1322, a third output buffer 1323, and a fourth output buffer 1314 connected to each stage 131.

Each stage 131 may receive a high voltage GVDD and a low voltage GVSS, and may transmit a predetermined voltage to the Q node and the Qb node, respectively. The first stage 131 may start operation by receiving the start pulse SP, and the remaining stages 131 may sequentially receive the carry signal Carry from the upper stage to operate. Each stage may generate a carry signal Carry and transfer the carry signal Carry to the next stage, but it is not limited thereto. For example, each stage 131 may generate a carry signal Carry in response to a clock signal and the voltage of the Q node, and transmit the generated carry signal Carry to the next stage.

The voltages transferred to the Q node and the Qb node may have opposite polarities from each other. That is, if the voltage level of the Q node is high, the voltage of the Qb node is low. Conversely, if the voltage level of the Q node is low, the voltage of the Qb node is high.

The first output buffer 1311 may output the first gate signal GATE1 (or GATE5, GATE9, GATE13) in response to the voltage of the Q node and the voltage of the Qb node, and the second output buffer 1312 may output the second gate signal GATE2 (or GATE6, GATE10, GATE14) in response to the voltage of the Q node and the voltage of the Qb node. The third output buffer 1313 may output the third gate signal GATE3 (or GATE7, GATE11, GATE15) in response to the voltage of the Q node and the voltage of the Qb node, and the fourth output buffer 1314 may output the fourth gate signal GATE4 (or GATE8, GATE12, GATE16) in response to the voltage of the Q node and the voltage of the Qb node.

In addition, the first output buffer 1311 includes a first transistor T1 including the first electrode to which the first clock signal SCLK1 is transmitted, the second electrode connected to the first output terminal SOUT1, and a gate electrode to which a voltage of the Q node is transmitted, a second transistor T2 including a first electrode connected to the first output terminal SOUT1, a second electrode to which a low voltage GVSS is transmitted, and a gate electrode in which a voltage of the Qb node are transmitted, and a first capacitor C1 disposed between the gate electrode of the first transistor T1 and the first output terminal SOUT1.

When the first transistor T1 is turned on by the voltage of the Q node, it may transmit the first clock signal SCLK1 to the first output terminal SOUT1. In this case, the second transistor T2 may be turned off by the voltage of the Qb node. Also, the first transistor T1 may be turned off by the voltage of the Q node. When the first transistor T1 is turned off, the second transistor T2 may be turned on by the voltage of the Qb node. When the second transistor T2 is turned on, the low voltage GVSS may be transmitted to the first output terminal SOUT1.

In addition, the second output buffer 1312 includes a third transistor T3 including the first electrode to which the second clock signal SCLK2 is transmitted, the second electrode connected to the second output terminal SOUT2, and a gate electrode to which a voltage of the Q node is transmitted, a fourth transistor T4 including a first electrode connected to the second output terminal SOUT2, a second electrode to which a low voltage GVSS is transmitted, and a gate electrode in which a voltage of the Qb node are transmitted, and a second capacitor C2 disposed between the gate electrode of the third transistor T3 and the second output terminal SOUT2.

When the third transistor T3 is turned on by the voltage of the Q node, the third transistor T3 may transmit the second clock signal SCLK2 to the second output terminal SOUT2. In this case, the fourth transistor T4 may be turned off by the voltage of the Qb node. Also, the third transistor T3 may be turned off by the voltage of the Q node. When the third transistor T3 is turned off, the fourth transistor T4 may be turned on by the voltage of the Qb node. When the fourth transistor T4 is turned on, the low voltage GVSS may be transferred to the second output terminal SOUT2.

In addition, the third output buffer 1313 includes a fifth transistor T5 including the first electrode to which the third clock signal SCLK3 is transmitted, the second electrode connected to the third output terminal SOUT3, and a gate electrode to which a voltage of the Q node is transmitted, a sixth transistor T6 including a first electrode connected to the third output terminal SOUT3, a second electrode to which a low voltage GVSS is transmitted, and a gate electrode in which a voltage of the Qb node are transmitted, and a third capacitor C3 disposed between the gate electrode of the fifth transistor T5 and the third output terminal SOUT3.

When the fifth transistor T5 is turned on by the voltage of the Q node, the fifth transistor T5 may transmit the third clock signal SCLK3 to the third output terminal SOUT3. In this case, the sixth transistor T6 may be turned off by the voltage of the Qb node. Also, the fifth transistor T5 may be turned off by the voltage of the Q node. When the fifth transistor T5 is turned off, the sixth transistor T6 may be turned on by the voltage of the Qb node. When the sixth transistor T6 is turned on, the low voltage GVSS may be transmitted to the third output terminal SOUT3.

In addition, the fourth output buffer 1314 includes a seventh transistor T7 including the first electrode to which the fourth clock signal SCLK4 is transmitted, the second electrode connected to the fourth output terminal SOUT4, and a gate electrode to which a voltage of the Q node is transmitted, an eighth transistor T8 including a first electrode connected to the fourth output terminal SOUT4, a second electrode to which a low voltage GVSS is transmitted, and a gate electrode in which a voltage of the Qb node are transmitted, and a fourth capacitor C4 disposed between the gate electrode of the seventh transistor T7 and the fourth output terminal SOUT4.

When the seventh transistor T7 is turned on by the voltage of the Q node, the seventh transistor T7 may transmit the fourth clock signal SCLK4 to the fourth output terminal SOUT4. In this case, the eighth transistor T8 may be turned off by the voltage of the Qb node. Also, the seventh transistor T7 may be turned off by the voltage of the Q node. When the seventh transistor T7 is turned off, the eighth transistor T8 may be turned on by the voltage of the Qb node. When the eighth transistor T8 is turned on, the low voltage GVSS may be transmitted to the fourth output terminal SOUT4.

A first diode circuit 1321 between the first output buffer 1311 and the Q node, a second diode circuit 1322 between the second output buffer 1312 and the Q node, a third diode circuit 1323 between the third output buffer 1313 and the Q node, and a fourth diode circuit 1324 between the fourth output buffer 1314 and the Q node may be disposed.

The fourth diode circuit 1324 may be disposed between the Q node and the gate electrode of the seventh transistor T7. When the voltage level of the Q node is greater than the voltage level of the gate electrode of the seventh transistor T7, a current flows from the Q node to the gate electrode of the seventh transistor T7 due to the fourth diode circuit 1324, but when the voltage level of the Q node is less than the voltage level of the gate electrode of the seventh transistor T7, the current may not flow from the gate electrode of the seventh transistor T7 to the Q node direction due to the fourth diode circuit 1324.

The third diode circuit 1323 may be disposed between the Q node and the gate electrode of the fifth transistor T5. When the voltage level of the Q node is greater than the voltage level of the gate electrode of the fifth transistor T5, a current flows from the Q node to the gate electrode of the fifth transistor T5 due to the third diode circuit 1323. However, if the voltage level of the Q node is less than the voltage level of the gate electrode of the fifth transistor T5, the current may not flow from the gate electrode of the fifth transistor T5 to the Q node direction due to the third diode circuit 1323.

The second diode circuit 1322 may be disposed between the Q node and the gate electrode of the third transistor T3. When the voltage level of the Q node is greater than the voltage level of the gate electrode of the third transistor T3, the current flows from the Q node to the gate electrode of the third transistor T3 due to the second diode circuit 1322. However, when the voltage level of the Q node is less than the voltage level of the gate electrode of the third transistor T3, the current may not flow from the gate electrode of the third transistor T3 to the Q node direction due to the second diode circuit 1322.

The first diode circuit 1321 may be disposed between the Q node and the gate electrode of the first transistor T1. When the voltage level of the Q node is greater than the voltage level of the gate electrode of the first transistor T1, a current flows from the Q node to the gate electrode of the first transistor T1 due to the first diode circuit 1311. However, when the voltage level of the Q node is less than the voltage level of the gate electrode of the first transistor T1, the current may not flow from the gate electrode of the first transistor T1 to the Q node direction due to the first diode circuit 1321.

As mentioned above, although the fourth diode circuit 1324 may be connected between the fourth output buffer 1314 and the Q node, the third diode circuit 1323 may be connected the third output buffer 1313 and the Q node, the second diode circuit 1322 may be connected between the second output buffer 1312 and the Q node, and the first diode circuit 1321 may be connected between the first output buffer 1311 and the Q node, but they are not limited thereto. For example, the first diode circuit 1321 may be connected only between the fourth output buffer 1314 and the Q node. In addition, the first to fourth diode circuits 1321 to 1324 may include diodes D1 to D4, reset transistors RT1 to RT4, diode-connected isolation transistors and reset transistors as shown in FIG. 9.

In addition, at least one of the first diode circuit 1321 to the fourth diode circuit 1324 may include a diode and a reset transistor, and the remainder may include a diode-connected isolation transistor and a reset transistor.

In addition, the gate driver circuit 130 may include a carry buffer 1301 for outputting a carry signal Carry in response to voltages of the Q node and the Qb node. The carry buffer 1301 may receive the carry clock signal CRCLK and output the carry signal Carry in response to voltages of the Q node and the Qb node.

The carry buffer 1301 may include a first carry transistor Tc1 including a first electrode to which the carry clock signal CRCLK is transmitted, a second electrode connected to the carry signal output terminal CO, and a gate electrode to which the voltage of the Q node is transmitted, a second carry transistor Tc2 including a first electrode connected to the carry signal output terminal CO, a second electrode through which the low voltage GVSS is transmitted, and a gate electrode through which the voltage of the Qb node is transmitted, and a carry capacitor C0 disposed between the gate electrode of the first carry transistor Tc1 and the carry signal output terminal CO.

When the first carry transistor Tc1 is turned on by the voltage of the first node Q, it may transmit the carry clock signal CRCLK to the carry signal output terminal CO. In this case, the second carry transistor Tc2 may be turned off by the voltage of the Qb node. Also, when the first carry transistor Tc1 is turned off by the voltage of the Q node, the second carry transistor Tc2 may be turned on by the voltage of the Qb node. When the second carry transistor Tc2 is turned on, the low voltage GVSS may be transmitted to the carry signal output terminal CO.

In addition, a carry diode circuit 1302 may be disposed between the gate electrode of the carry transistor Tc1 and the Q node. The carry diode circuit 1302 may further include a carry diode D0 and a carry reset transistor RT0.

The above-described gate driver circuit 130 may output four gate signals in one stage. Accordingly, since the number of stages included in the gate driver circuit 130 can be reduced, the size of the gate driver circuit 130 may be implemented to be small. When the size of the gate driver circuit 130 is decreased, the area of the non-display region 110*b* of the display panel 110 may be reduced, and thus the bezel of the display device 100 may be reduced. In addition, the problem that the falling time of the gate signal becomes long can be solved, so that no deterioration of image quality occurs at high resolution.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A gate driver circuit, comprising:

a stage configured to output at least two gate signals, wherein the stage comprises:

a first output buffer configured to output a first gate signal in response to a voltage of a Q node and a voltage of a Qb node;

a second output buffer configured to output a second gate signal in response to the voltage of the Q node and the voltage of the Qb node; and a first diode circuit disposed between the Q node and the second output buffer, the first diode circuit comprising:

a first diode or a first isolation transistor; and a first reset transistor, wherein an anode electrode and a cathode electrode of the first diode are respectively connected to the Q node and the second output buffer, and a first electrode, a second electrode and a gate electrode of the first isolation transistor are respectively connected to the Q node, the second output buffer and the Q node, and a first electrode, a second electrode, and a gate electrode of the first reset transistor are respectively connected to the Q node, the second output buffer, and the Qb node.

2. The gate driver circuit according to claim 1, wherein the first output buffer comprises:

a first transistor comprising a first electrode to which a first clock signal is transmitted, a second electrode connected to a first output terminal, and a gate electrode to which the voltage of the Q node is transmitted;

a second transistor including a first electrode connected to the first output terminal, a second electrode to which a low voltage is transmitted and a gate electrode to which the voltage of the Qb node is transmitted, and a first capacitor disposed between the gate electrode of the first transistor and the first output terminal, wherein the second output buffer comprises:

a third transistor including a first electrode to which a second clock signal is transmitted, a second electrode connected to a second output terminal and a gate electrode to which the voltage of the Q node is transmitted, a fourth transistor including a first electrode connected to the second output terminal, a second electrode to which a low voltage is transmitted and a gate electrode to which the voltage of the Qb node is transmitted, and a second capacitor disposed between the gate electrode of the third transistor and the second output terminal.

3. The gate driver circuit according to claim 2, wherein the cathode electrode of the first diode is connected to the gate electrode of the third transistor, and the second electrode of the first reset transistor is connected to the gate electrode of the third transistor.

4. The gate driver circuit according to claim 2, wherein the second electrode of the first isolation transistor is connected to the gate electrode of the third transistor; and the second electrode of the first isolation transistor is connected to the gate electrode of the third transistor.

5. The gate driver circuit according to claim 2, further comprising:

a second diode circuit disposed between the Q node and the first output buffer.

6. The gate driver circuit according to claim 5, wherein the second diode circuit comprises:

a second diode including an anode electrode connected to the Q node and a cathode electrode connected to the gate electrode of the first transistor; and a second reset transistor including a first electrode connected to the Q node, a second electrode connected to the gate electrode of the first transistor, and a gate electrode connected to the Qb node.

7. The gate driver circuit according to claim 5, wherein the second diode circuit comprises:

a second isolation transistor including a first electrode connected to the Q node, a second electrode connected to the gate electrode of the first transistor, and a gate electrode connected to the Q node; and a second reset transistor including a first electrode connected to the Q node, a second electrode connected to the gate electrode of the first transistor, and a gate electrode connected to the Qb node.

8. The gate driver circuit according to claim 1, wherein a falling time of the second gate signal is less than or equal to a falling time of the first gate signal.

9. The gate driver circuit according to claim 8, wherein a slope of the second gate signal at the falling time of the second gate signal is greater than or equal to a slope of the first gate signal at the falling time of the first gate signal.

10. A display device, comprising:

a display panel comprising a plurality of pixels receiving data signals and gate signals respectively from a plurality of data lines and a plurality of gate lines;

a data driver circuit configured to supply the data signals to the plurality of data lines;

a gate driver circuit configured to sequentially supply the gate signals to the plurality of gate lines, the gate driver circuit comprising a stage for outputting at least two gate signals; and a timing controller configured to control the data driver circuit and the gate driver circuit;

wherein the stage comprises:

a first output buffer configured to output a first gate signal in response to a voltage of a Q node and a voltage of a Qb node, a second output buffer configured to output a second gate signal in response to the voltage of the Q node and the voltage of the Qb node, and a first diode circuit disposed between the Q node and the second output buffer, the first diode circuit comprising:

a first diode or a first isolation transistor; and a first reset transistor, wherein an anode electrode and a cathode electrode of the first diode are respectively connected to the Q node and the second output buffer, and a first electrode, a second electrode, and a gate electrode of the first isolation transistor are respectively connected to the Q node, the second output buffer, and the Q node, and a first electrode, a second electrode, and a gate electrode of the first reset transistor are respectively connected to the Q node, the second output buffer and the Qb node.

11. The display device according to claim 10, wherein the first output buffer comprises:

a first transistor including a first electrode to which a first clock signal is transmitted, a second electrode connected to a first output terminal, and a gate electrode to which the voltage of the Q node is transmitted, a second transistor including a first electrode connected to the first output terminal, a second electrode to which a low voltage is transmitted and a gate electrode to which the voltage of the Qb node is transmitted, and a first capacitor disposed between the gate electrode of the first transistor and the first output terminal, and wherein the second output buffer comprises:

a third transistor including a first electrode to which a second clock signal is transmitted, a second electrode connected to a second output terminal, and a gate electrode to which the voltage of the Q node is transmitted, a fourth transistor including a first electrode connected to the second output terminal, a second electrode to which a low voltage is transmitted and a gate electrode to which the voltage of the Qb node is transmitted, and a second capacitor disposed between the gate electrode of the third transistor and the second output terminal.

12. The display device according to claim 11, wherein the cathode electrode of the first diode is connected to the gate electrode of the third transistor, and the second electrode of the first reset transistor is connected to the gate electrode of the third transistor.

13. The display device according to claim 11, wherein the second electrode of the first isolation transistor is connected to a gate electrode of the third transistor, and the second electrode of the first reset transistor is connected to a gate electrode of the third transistor.

14. The display device according to claim 11, wherein the stage further comprises a second diode circuit disposed between the Q node and the first output buffer.

15. The display device according to claim 14, wherein the second diode circuit comprises:

a second diode including an anode electrode connected to the Q node and a cathode electrode connected to the gate electrode of the first transistor, and a second reset transistor including a first electrode connected to the Q node, a second electrode connected to the gate electrode of the first transistor, and a gate electrode connected to the Qb node.

16. The display device according to claim 14, wherein the second diode circuit comprises:

a second isolation transistor including a first electrode connected to the Q node, a second electrode connected to a gate electrode of the first transistor, and a gate electrode connected to the Q node, and a second reset transistor including a first electrode connected to the Q node, a second electrode connected to the gate electrode of the first transistor, and a gate electrode connected to the Qb node.

17. The display device according to claim 10, wherein a falling time of the second gate signal is less than or equal to a falling time of the first gate signal.

18. The display device according to claim 17, wherein a slope of the second gate signal at the falling time of the second gate signal is greater than or equal to a slope of the first gate signal at the falling time of the first gate signal.

* * * * *